US006802329B2

(12) United States Patent
Chen

(10) Patent No.: US 6,802,329 B2
(45) Date of Patent: Oct. 12, 2004

(54) TOP SETTING-UP MECHANISM FOR FOLDING TENT

(76) Inventor: Shih-Ching Chen, No. 69, Baujung Rd.., Shindian City, Taipei (TW), 231

( * ) Notice: Subject to any disclaimer, the term of this patent is extended or adjusted under 35 U.S.C. 154(b) by 0 days.

(21) Appl. No.: 10/372,163

(22) Filed: Feb. 25, 2003

(65) Prior Publication Data

US 2004/0163696 A1 Aug. 26, 2004

(51) Int. Cl.[7] ..... E04H 15/36

(52) U.S. Cl. ..... 135/135; 135/155; 135/20.1; 135/21

(58) Field of Search ..... 135/135, 155, 135/20.1, 21

(56) References Cited

U.S. PATENT DOCUMENTS 344,094 A * 6/1886 Fosburgh ..... 135/21
2,771,087 A * 11/1956 Simonson ..... 135/126
4,201,237 A * 5/1980 Watts et al. ..... 135/98
4,202,363 A * 5/1980 Watts et al. ..... 135/98
5,871,026 A * 2/1999 Lin ..... 135/98
6,478,037 B2 * 11/2002 Tung ..... 135/21
2002/0092550 A1 * 7/2002 Chang ..... 135/20.3

* cited by examiner

*Primary Examiner*—Korie Chan
*Assistant Examiner*—Naschica S. Morrison
(74) *Attorney, Agent, or Firm*—Rosenberg, Klein & Lee

(57) ABSTRACT

A top setting-up mechanism for folding tent includes an upper hub pivotally connected to inner ends of upper ribs of the tent, a lower hub pivotally connected to inner ends of stretchers of the tent, and a pull cord. A guiding tube having internal guiding ribs is fitted in the upper hub. An upper part of the lower hub is formed into a hollow retainer having external guiding grooves. When the pull cord is pulled, the retainer on the lower hub is brought into the guiding tube to enable quick and accurate coupling of the lower hub to the upper hub, and the guiding grooves on the retainer of the lower hub interfere with the guiding ribs on the guiding tube fitted in the upper hub to prevent the upper and the lower hub from turning relative to one another, and thereby ensures a stable erection of the tent.

4 Claims, 8 Drawing Sheets

TOP SETTING-UP MECHANISM FOR FOLDING TENT

FIELD OF THE INVENTION

The present invention relates to a setting-up mechanism for tent, and more particularly to a setting-up mechanism located at a top of a folding tent to enable quick and accurate erection and collapse of the folding tent.

BACKGROUND OF THE INVENTION

A folding tent includes a collapsible skeleton on which a waterproof cover is supported. Basically, the collapsible skeleton is structurally similar to a folding umbrella skeleton and has a setting-up mechanism provided at a top thereof. The setting-up mechanism mainly includes an upper hub and a lower hub, both of which have a plurality of radially extended ribs pivotally connected thereto. The upper-and the lower hub may be coupled to or separated from each other to stretch or collapse the folding tent, respectively. This type of folding tent is widely welcome because it can be easily folded and stretched, and occupies a very small volume after being folded to facilitate convenient carry on a station wagon. U.S. Pat. No. 6,354,316 granted to the same applicant of the present invention discloses a folding tent.

FIG. 1 illustrates a skeleton for a conventional folding tent. The skeleton includes a hollow upper hub 11A having a plurality of upper ribs 141 pivotally connected at inner ends to an outer wall of the upper hub, a plurality of lower ribs 143 connected at inner ends to outer ends of the upper ribs 141 via knuckles 136 that allow the lower ribs 143 to straighten from or fold to the upper ribs 141, a lower hub 12A having a plurality of stretchers 142 pivotally connected at inner ends to an outer wall of the lower hub while outer ends of the stretchers 142 are pivotally connected to the upper ribs 141 at predetermined positions, and a pull cord 21 upwardly extended from a top of the lower hub 12A through a center hole of the upper hub 11A to expose from the setting-up mechanism.

When the pull cord 21 is upwardly pulled as indicated by the arrow in FIG. 1, the lower hub 12A is moved toward the upper hub 11A until a projection 12A1 on the top of the lower hub is engaged with an inner space of the hollow upper hub 11A. At this point, the stretchers 142 are caused to stretch outward to extend the upper ribs 141 outward. The cover supported on the ribs 141, 143 is simultaneously stretched to complete the tent for use outdoors, as shown in FIG. 2. To fold or collapse the tent, the lower hub 12A must be moved out of the upper hub 11A to collapse the whole skeleton.

The above-structured conventional tent may be easily folded and extended. However, the upper and the lower hub 11A, 12A forming the setting-up mechanism are connected to one another only through engagement of the projection 12A1 on the top of the lower hub 12A with the hollow upper hub 11A when the lower hub 12A is pulled upward by the pull cord 21. Since there is not any guiding means provided between the upper and the lower hub 11A, 12A, the projection 12A1 tends to extend into the hollow upper hub 11A to a non-centered position and result in uneven stretching of the stretchers 142. The tent must therefore be collapsed and re-erected again.

Moreover, since the tent is for use outdoors, it is often subject to strong wind. As an effect of torsional force, it is possible the upper and the lower hubs 11A, 12A are unexpectedly disengaged from each other under the strong wind, resulting in a collapsed tent or even an accident. This is a serious disadvantage of the conventional folding tent.

SUMMARY OF THE INVENTION

It is therefore a primary object of the present invention to provide a top setting-up mechanism for folding tent to eliminate the drawbacks existed in the conventional folding tent.

To achieve the above object, the top setting-up mechanism for folding tent according to the present invention includes an upper hub having a guiding tube tightly fitted therein, and a lower hub having a hollow retainer provided at an upper part thereof. The guiding tube is provided at a lower part of an inner wall surface with symmetrically arranged guiding ribs, and the retainer on the lower hub is provided on an outer wall surface with symmetrically arranged guiding grooves for engaging with the guiding ribs on the guiding tube. A pull cord is upward extended from a bottom cap beneath the lower hub through the hollow retainer, the guiding tube, and the upper hub to expose from the setting-up mechanism. When the pull cord is upward pulled, the retainer on the lower hub is guided into the guiding tube with the guiding grooves on the retainer interfering with the guiding ribs in the guiding tube, enabling the retainer to accurately move into the guiding tube fitted in the upper hub.

Another object of the present invention is to provide a top setting-up mechanism for folding tent having an upper hub, a lower hub, and a pull cord, wherein the pull cord is upward extended from a bottom of the lower hub, allowing a pull force applied on the pull cord to evenly distribute over the bottom of the lower hub for a retainer on a top of the lower hub to accurately move into a guiding tube fitted in the upper hub and thereby stretch the folding tent.

A further object of the present invention is to provide a top setting-up mechanism for folding tent having an upper hub, a lower hub, and a pull cord, wherein the pull cord may be otherwise downward extended from a top of the upper hub through the lower hub to expose from the setting-up mechanism, so that a shorter user may conveniently operate the pull cord to stretch a high folding tent from a low position.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
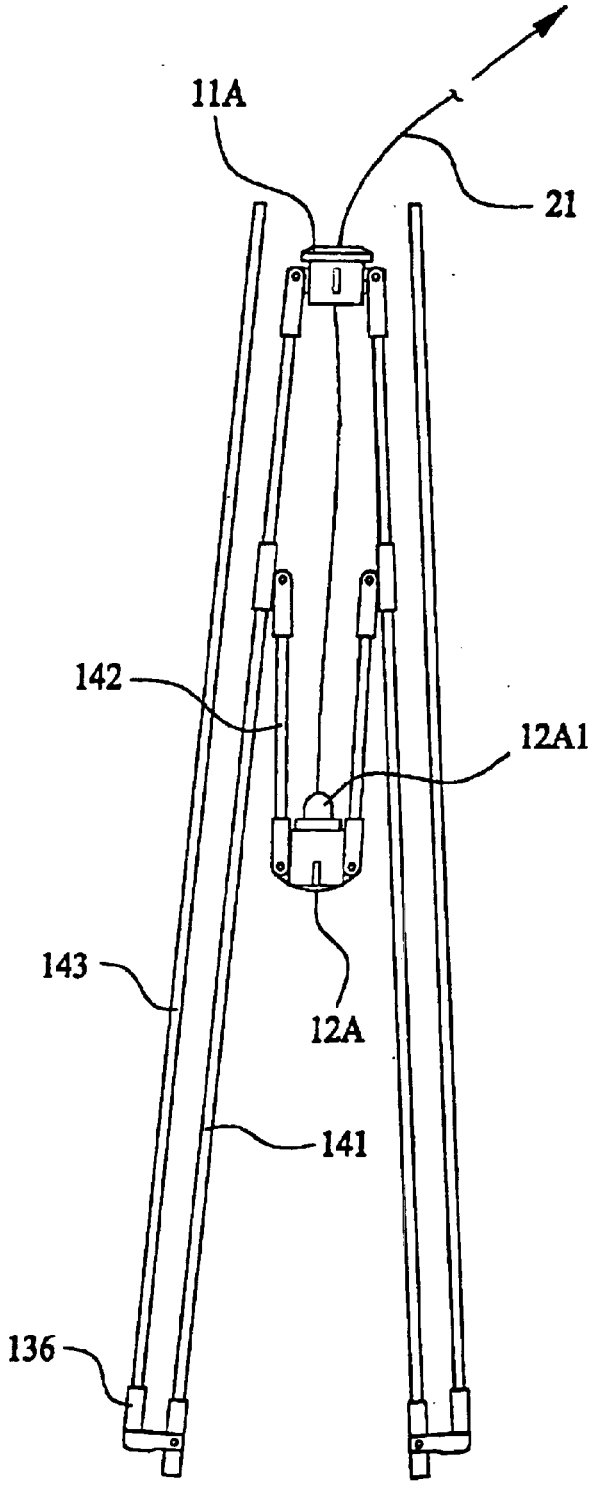
FIG. 1 PRIOR ART
FIG. 1 shows a skeleton for a conventional folding tent in a folded state.
Figure 2:
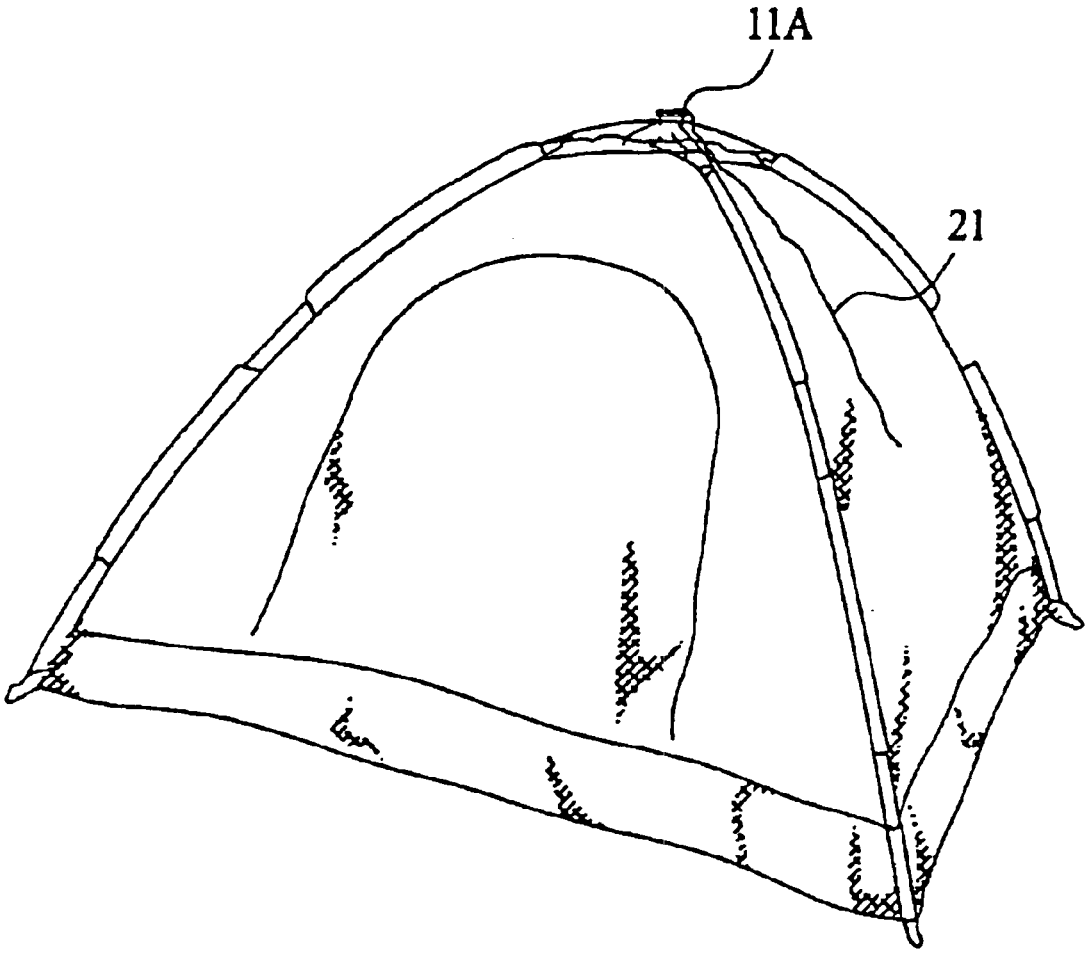
FIG. 2 PRIOR ART
FIG. 2 is a perspective view of a conventional folding tent in an extended state.
Figure 3:
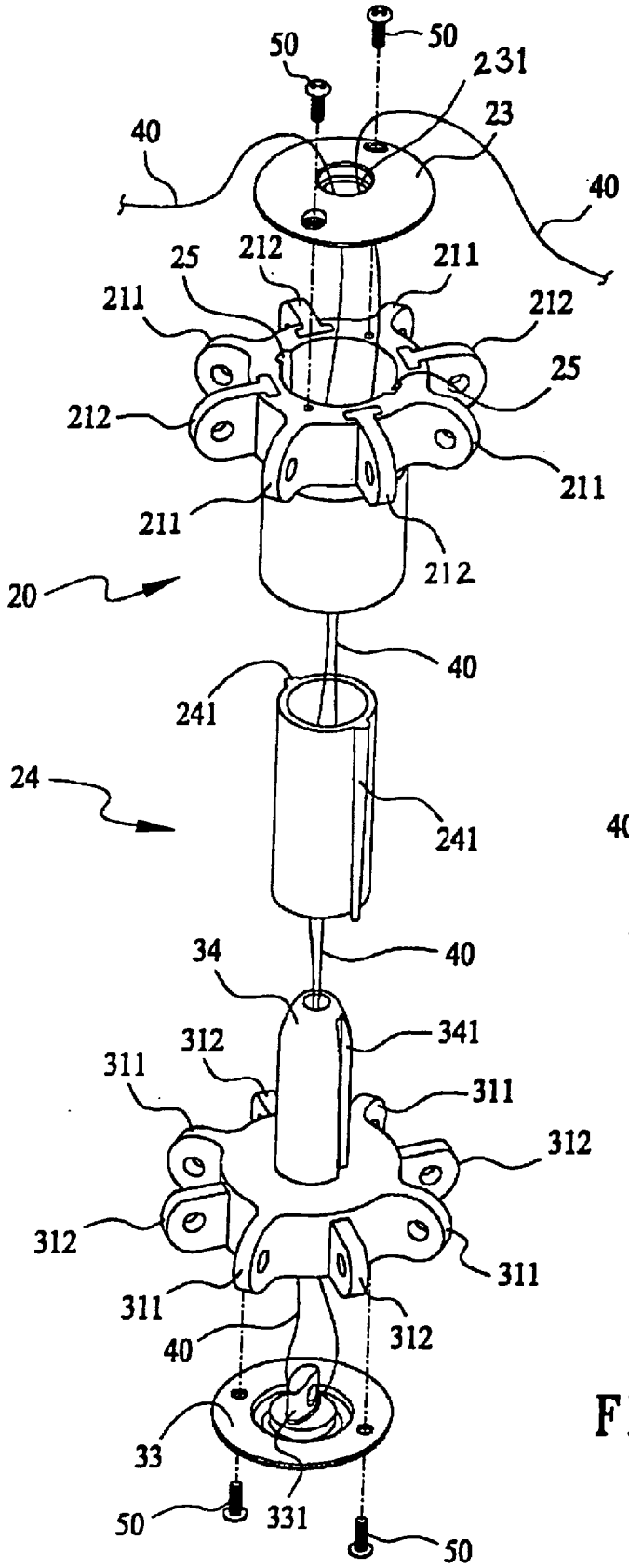
FIG. 3 is an exploded perspective view of a top setting-up mechanism for folding tent according to a first embodiment of the present invention.
Figure 4:
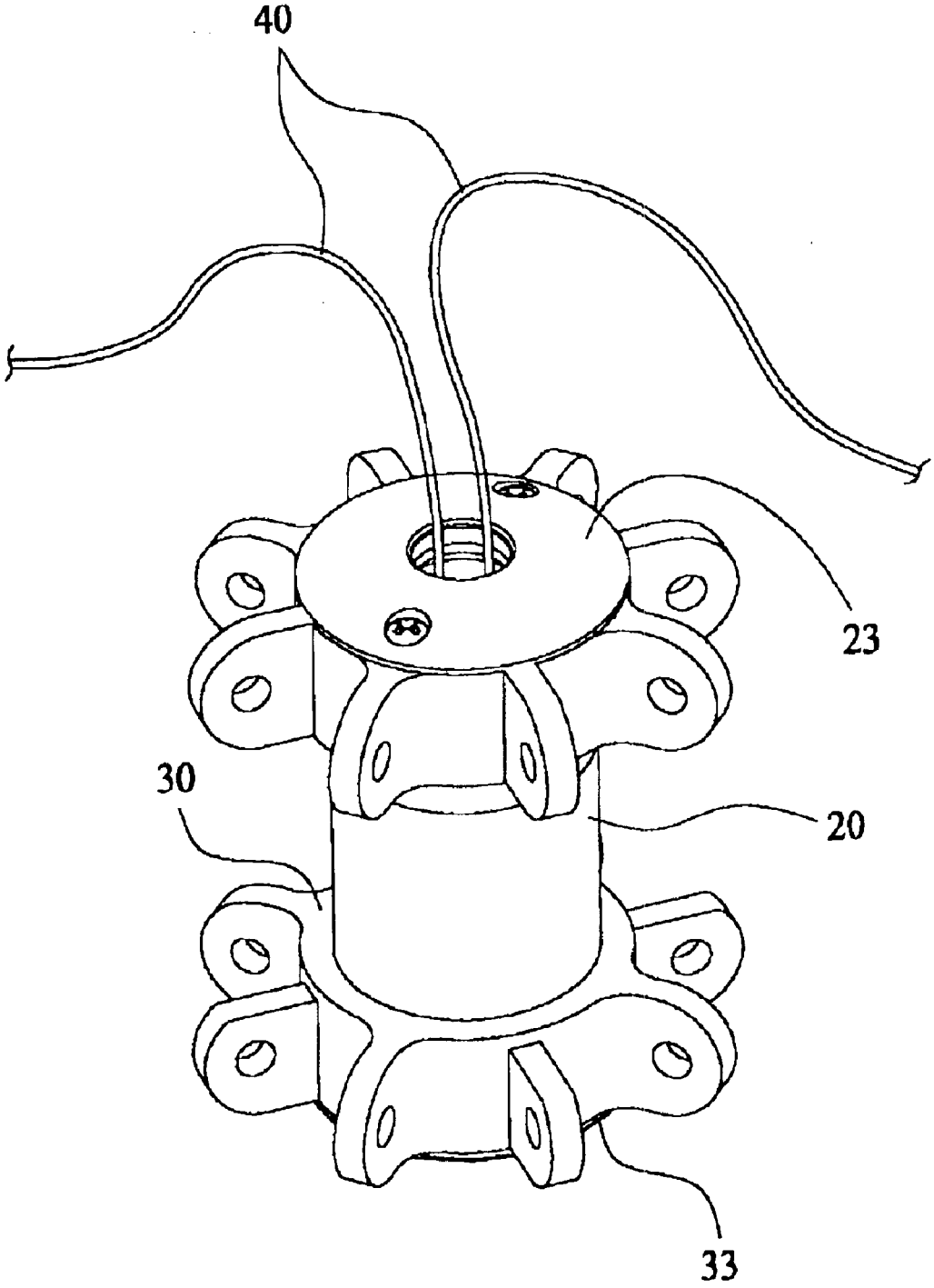
FIG. 4 is an assembled perspective view of the present invention.

Please refer to FIGS. 3 and 4. The present invention relates to a top setting-up mechanism for folding tent. The mechanism mainly includes an upper hub 20 and a lower hub 30.

Figure 8:
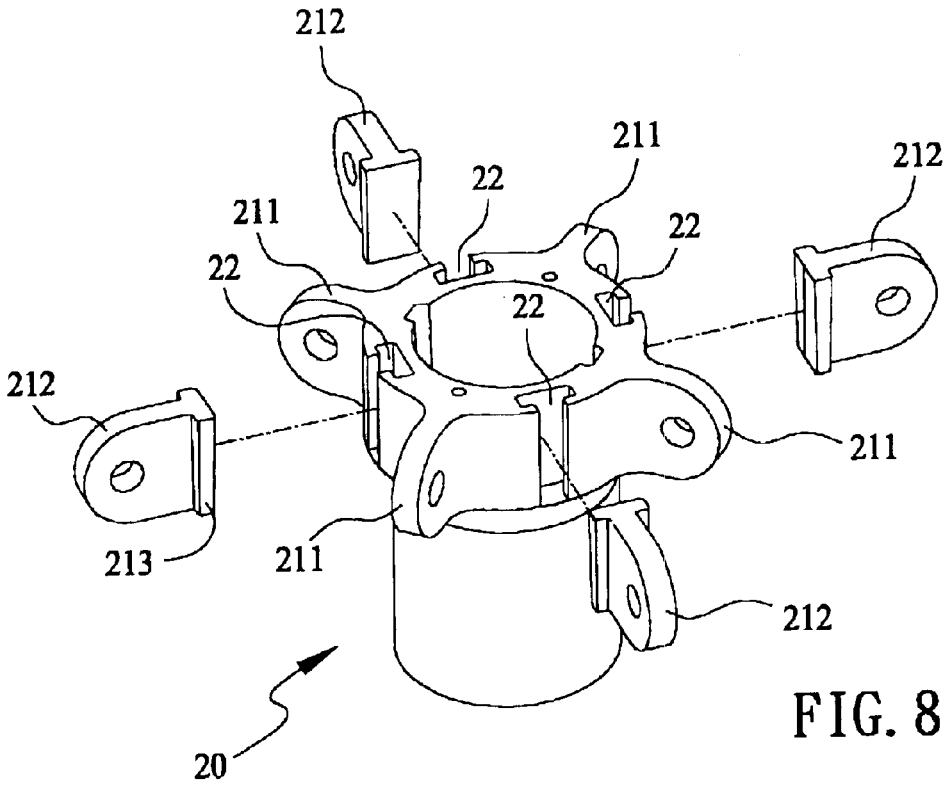
FIG. 8 is an exploded perspective view of the upper hub for the setting-up mechanism of the present invention.

The upper hub 20 is a hollow tubular member having four fixed lugs 211 and four removable lugs 212 provided on an upper part of an outer wall surface thereof. As can be seen from FIG. 8 that is an exploded perspective view of the upper hub 20, each of the removable lugs 212 is provided at an inner end surface with a retaining block 213, which is adapted to engage with a retaining groove 22 provided between two adjacent fixed lugs 211. The fixed and the removable lugs 211, 212 are provided with a round hole each. As in the conventional folding tent, a pivotally turnable means may be connected to the round holes, so as to connect the upper hub 20 to upper ribs of the skeleton of the folding tent. The provision of both fixed and removable lugs 211, 212 gives a user the choice of four, six, or eight ribs for the tent. A top cap 23 is fastened to a top of the upper hub 20 by means of screws 50. The top cap 23 has a centered round hole 231, through which a pull cord 40 is upward extended.

Figure 3A:
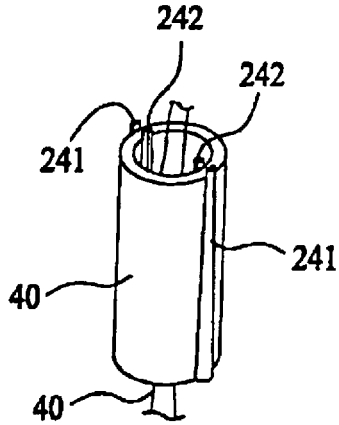
FIG. 3A is a bottom perspective view of a guiding tube included in the present invention.

A guiding tube 24 in the form of a hollow tubular member and having an outer diameter slightly smaller than an inner diameter of the upper hub 20 is provided for locating in the upper hub 20. The guiding tube 24 is provided on an outer wall surface with axially extended ridges 241 for engaging with long grooves 25 correspondingly provided on an inner wall surface of the upper hub 20, so that the guiding tube 24 may be tightly fitted in the upper hub 20 with the ridges 241 engaged with the long grooves 25. Please refer to FIG. 3A that shows the guiding tube 24 in an upside down position. As can be seen from FIG. 3A, the guiding tube 24 is provided at a lower part of an inner wall surface with guiding ribs 242.

Figure 9:
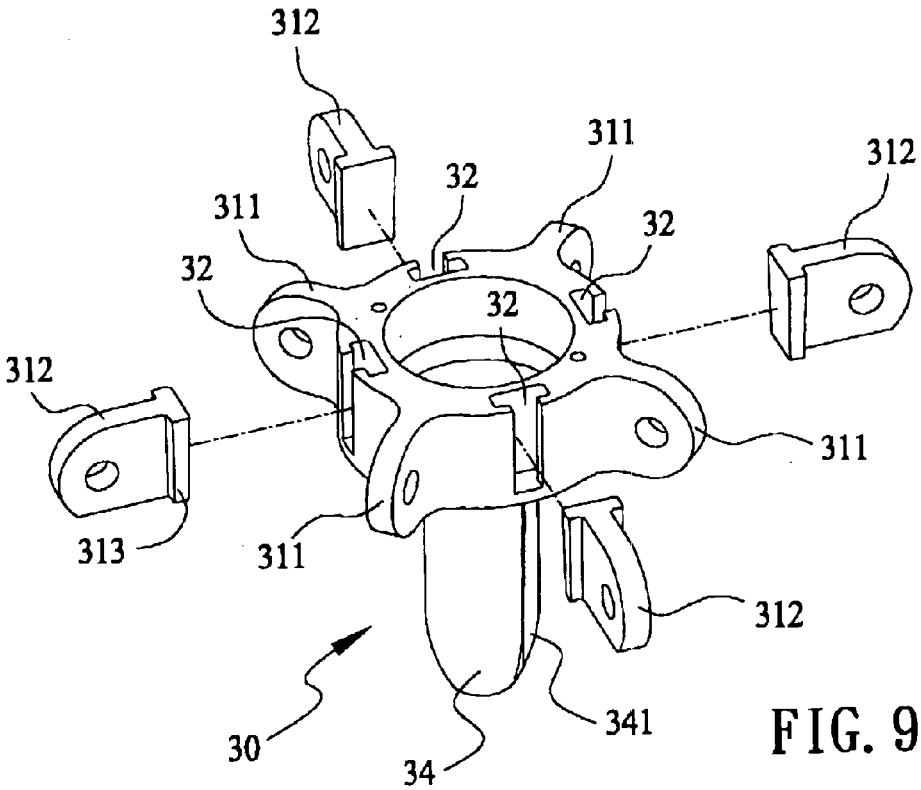
FIG. 9 is an exploded bottom perspective view of the lower hub for the setting-up mechanism of the present invention.

The lower hub 30 is provided on a lower part of an outer wall surface with four fixed lugs 311 and four removable lugs 312. As can be seen from FIG. 9 that is an exploded bottom perspective view of the lower hub 30, each of the removable lugs 312 is provided at an inner end surface with a retaining block 313, which is adapted to engage with a retaining groove 32 provided between two adjacent fixed lugs 311. The fixed and the removable lugs 311, 312 are provided with a round hole each. As in the conventional folding tent, a pivotally turnable means may be connected to the round holes, so as to connect the lower hub 30 to stretchers of the skeleton of the folding tent. The provision of both fixed and removable lugs 311, 312 gives a user the choice of four, six, or eight ribs for the tent to match with the upper hub 20. An upper part of the lower hub 30 is formed into a hollow retainer 34 for the pull cord 40 to extend therethrough. The retainer 34 is provided on an outer surface with axially extended guiding grooves 341 adapted to interfere with the guiding ribs 242 provided at the inner lower part of the guiding tube 24. With these arrangements, the lower hub 30 may be directionally guided into the guiding tube 24 without turning relative to the guiding tube 24. A bottom cap 33 is fastened to a bottom of the lower hub 30 by means of screws 50. The bottom cap 33 has an upward projection 331 provided at a center thereof for the pull cord 40 to extend therethrough.

Two ends of the pull cord 40 extended through the upward projection 331 on the bottom cap 33 are sequentially extended through the lower hub 30, the guiding tube 24, the upper hub 20, and the top cap 23 to expose from the setting-up mechanism of the present invention.

Figure 5:
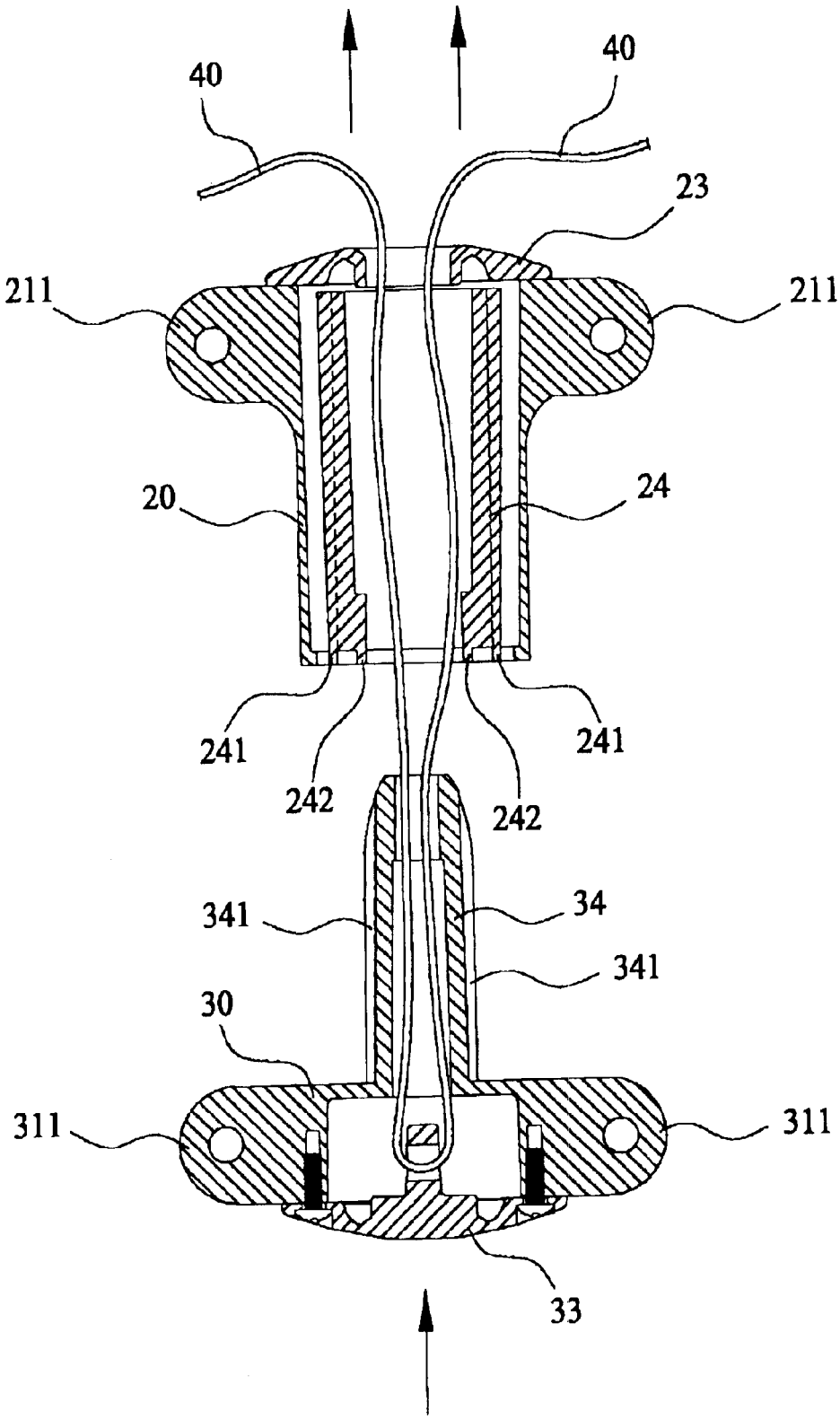
FIG. 5 is a sectional view of the present invention with upper and lower hubs thereof in a separated state.
Figure 6:
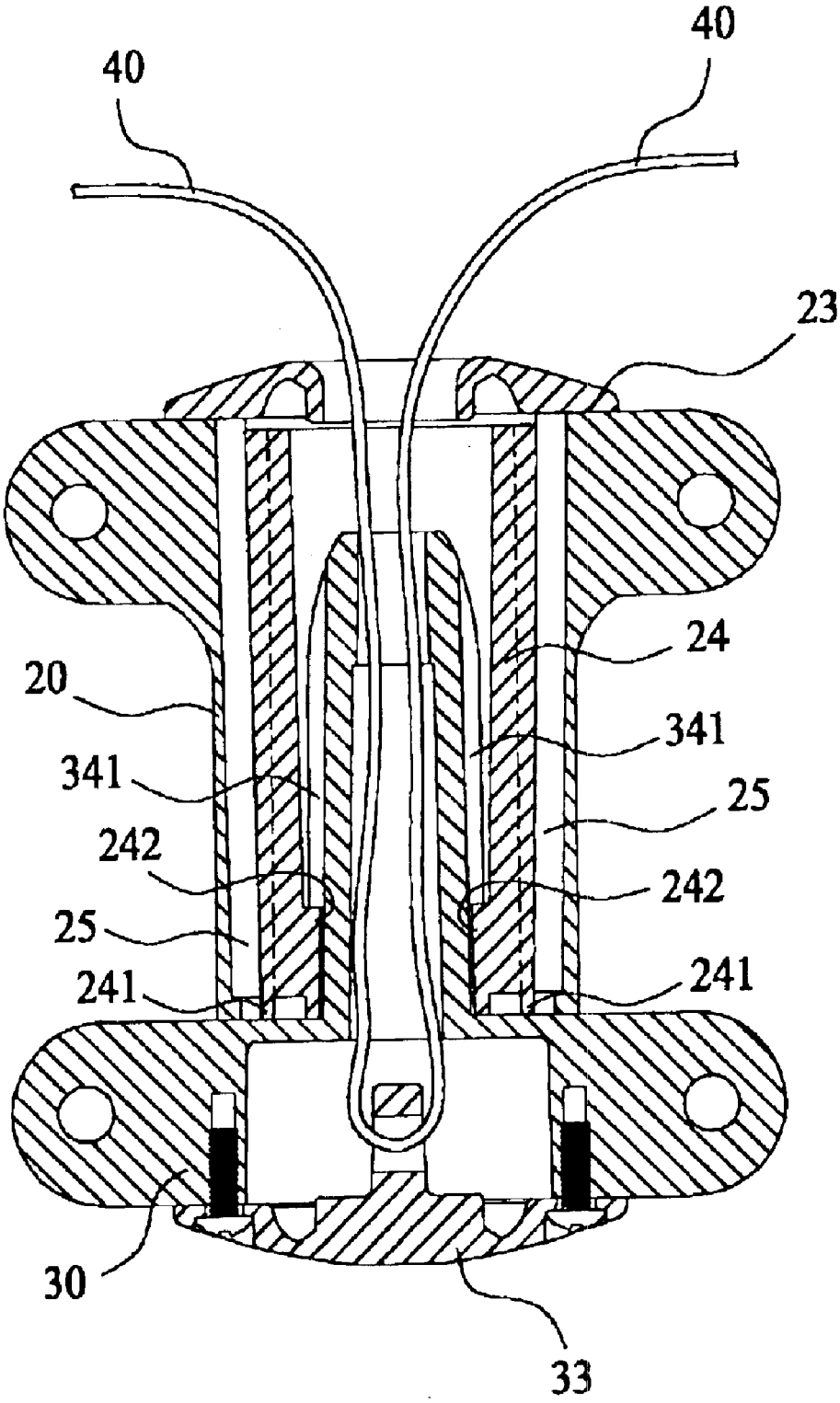
FIG. 6 is a sectional view of the present invention with upper and lower hubs thereof in a coupled state.

Please refer to FIG. 5. To extend the folding tent for use, simply upward pull the pull cord 40 to move the lower hub 30 toward the upper hub 20 with the retainer 34 on the lower hub 30 aligned with the guiding tube 24 that is tightly fitted in the upper hub 20. When the guiding groove 341 on the outer wall surface of the retainer 34 interfere with the guiding ribs 242 on the inner lower part of the guiding tube 24, the lower hub 30 is prevented from turning to allow the retainer 34 to fully enter into the guiding tube 24, as shown in FIG. 6. At this point, the upper and the lower hub 20, 30 are coupled together and the top of the whole tent skeleton is stretched like an umbrella. A user may then straighten the folded upper and lower ribs of the tent for the tent to stably position on the ground.

Please refer to FIG. 6. When the upper and the lower hub 20, 30 are coupled together, the mutual interference of the guiding ribs 242 on the guiding tube 24 with the guiding grooves 341 on the retainer 34 not only permits easy and accurate connection of the lower hub 30 to the upper hub 20, but also prevents the coupled upper and lower hubs 20, 30 from turning and loosening relative to one another when the erected tent is subjected to strong wind.

Moreover, since the pull cord 40 is upward extended from the projection 331 of the bottom cap 33 beneath the lower hub 30, any further upward pulling force applied on the pull cord 40 is evenly distributed by the bottom cap 33 over the bottom of the lower hub 30 to ensure a stable ascending of the lower hub 30 and accordingly, an accurate alignment and engagement of the retainer 34 with the guiding tube 24.

Figure 7:
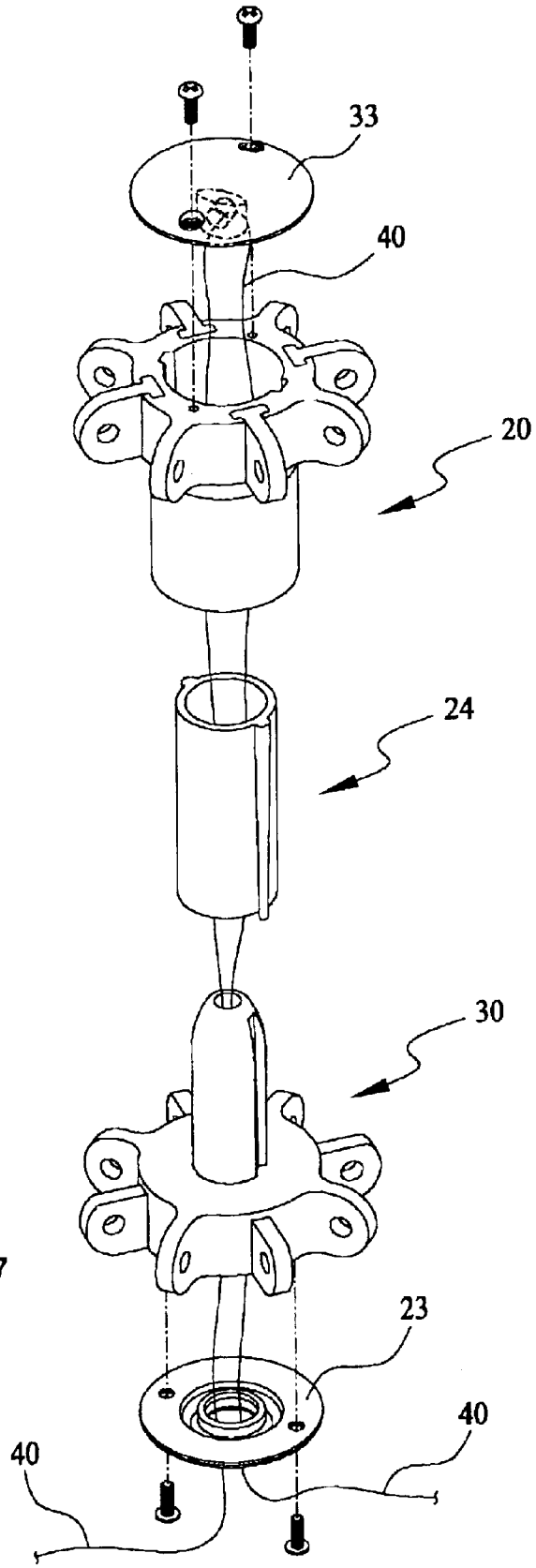
FIG. 7 is an exploded perspective view of a top setting-up mechanism for folding tent according to another embodiment of the present invention, wherein a pull cord thereof is a downward pulled cord.

FIG. 7 shows a second embodiment of the present invention. This second embodiment is similar to the first one, except that the bottom cap 33 and the top cap 23 are exchanged in their positions. That is, the bottom cap 33 in the first embodiment is now fastened to the top of the upper hub 20 and the top cap 23 is now fastened to the bottom of the lower hub 30. With this arrangement, the pull cord 40 is downward extended from the top of the upper hub 20 and can be downward pulled to connect the upper hub 20 to the lower hub 30 and thereby stretches the whole tent skeleton. This embodiment is suitable for a high tent or a shorter user. The downward extended pull cord 40 allows a shorter user to pull the cord from a low position and therefore stretch the tent more easily.

In brief, the top setting-up mechanism for folding tent according to the present invention enables quicker, more accurate, and more stable stretching and setting up of a folding tent as compared to the conventional folding tent.

What is claimed is:

1. A top setting-up mechanism for a folding tent, said folding tent having a collapsible skeleton including from inner to outer side a plurality of radially extended stretchers, upper ribs, and lower ribs, said top setting-up mechanism comprising:

an upper hub that is a hollow tubular member having a plurality of radially projected lugs spaced on an upper part of an outer wall surface thereof for pivotally connecting to inner ends of said upper ribs, and having long grooves axially provided on an inner wall surface thereof; a first cap having a centered round hole being fixedly fastened to a top of said upper hub; and a hollow guiding tube having guiding ribs provided at a lower part of an inner wall surface being fixedly fitted in said hollow upper hub;

a lower hub having a plurality of radially projected lugs spaced on a lower part of an outer wall surface thereof for pivotally connecting to inner ends of said stretchers, and an upper part of said lower hub formed into a hollow retainer; said retainer being provided on an outer wall surface thereof with guiding grooves corresponding to said guiding ribs provided on said inner lower part of said guiding tube to interfere with said guiding ribs; a second cap being fixedly fastened to a bottom of said lower hub, and having a centered axial projection extended toward said lower hub; and a pull cord that is extended through said axial projection on said second cap with two ends of said pull cord sequentially upward extended through said lower hub, said guiding tube, said upper hub, and said first cap to expose from said setting-up mechanism;

whereby when said pull cord is upwardly pulled, said lower hub is moved toward said upper hub with said retainer on said lower hub extending into said guiding tube to engage said guiding grooves on said retainer with said guiding ribs in said guiding tube, preventing said lower hub and said upper hub from turning relative to one another after they are filly coupled together.

2. The top setting-up mechanism for folding tent as claimed in claim 1, wherein said upper hub is provided on said inner wall surface with said axially extended long grooves, and said guiding tube being provided on an outer wall surface thereof with axially extended ridges adapted to engage with said long grooves on said upper hub, such that said guiding tube may be stably fitted in said upper hub with said ridges engaged with said long grooves.

3. The top setting-up mechanism for folding tent as claimed in claim 1, wherein said lugs on said upper hub include fixed and removable lugs, each of said removable lugs on said upper hub being provided at an inner end surface with a retaining block adapted to engage with a retaining groove provided on the outer wall surface of said upper hub between two said fixed lugs adjacent to one another; and said lugs on said lower hub including fixed and removable lugs, and each of said removable lugs on said lower hub being provided at an inner end surface with a retaining block adapted to engage with a retaining groove provided on the outer wall surface of said lower hub between two said fixed lugs adjacent to one another.

4. A top setting-up mechanism for folding tent, said folding tent having a collapsible skeleton including from inner to outer side a plurality of stretchers, upper ribs, and lower ribs, said top setting-up mechanism comprising:

an upper hub that is a hollow tubular member having a plurality of radially projected lugs spaced on an upper part of an outer wall surface thereof for pivotally connecting to inner ends of said upper ribs, and having long grooves axially provided on an inner wall surface thereof; a first cap being fixedly fastened to a top of said upper hub, and having a centered axial projection extended toward said upper hub; and a hollow guiding tube having guiding ribs provided at a lower part of an inner wall surface being fixedly fitted in said hollow upper hub;

a lower hub having a plurality of radially projected lugs spaced on a lower part of an outer wall surface thereof for pivotally connecting to inner ends of said stretchers, and an upper part of said lower hub formed into a hollow retainer; said retainer being provided on an outer wall surface thereof with guiding grooves corresponding to said guiding ribs provided on said inner lower part of said guiding tube to interfere with said guiding ribs; a second cap having a centered round hole being fixedly fastened to a bottom of said lower hub; and a pull cord that is extended through said axial projection on said first cap with two ends of said pull cord sequentially downward extended through said upper hub, said guiding tube, said lower hub, and said second cap to expose from said setting-up mechanism;

whereby when said pull cord is downwardly pulled, said upper hub is moved toward said lower hub with said retainer on said lower hub extending into said guiding tube to engage said guiding grooves on said retainer with said guiding ribs in said guiding tube, preventing said lower hub and said upper hub from turning relative to one another after they are fully coupled together.

* * * * *